US009841248B2

(12) United States Patent
Bybee

(10) Patent No.: US 9,841,248 B2
(45) Date of Patent: Dec. 12, 2017

(54) HEAT DISSIPATION ASSEMBLY INCORPORATED INTO A HANDGUARD SURROUNDING A RIFLE BARREL

(71) Applicant: Bradley W. Bybee, Kalkaska, MI (US)

(72) Inventor: Bradley W. Bybee, Kalkaska, MI (US)

( * ) Notice: Subject to any disclaimer, the term of this patent is extended or adjusted under 35 U.S.C. 154(b) by 5 days.

(21) Appl. No.: 15/174,507

(22) Filed: Jun. 6, 2016

(65) Prior Publication Data

US 2016/0356567 A1 Dec. 8, 2016

Related U.S. Application Data

(60) Provisional application No. 62/171,303, filed on Jun. 5, 2015.

(51) Int. Cl.

| | |
|---|---|
| ***F41A 13/12*** | (2006.01) |
| ***F41C 23/16*** | (2006.01) |
| ***F41A 13/10*** | (2006.01) |
| ***F41A 21/24*** | (2006.01) |
| *F41A 21/48* | (2006.01) |

(52) U.S. Cl.

CPC ..... *F41A 13/10* (2013.01); *F41A 21/24* (2013.01); *F41C 23/16* (2013.01); *F41A 21/48* (2013.01)

(58) Field of Classification Search

CPC ..... F41A 13/10; F41A 21/24; F41A 21/48; F41A 13/12; F41A 21/32; F41A 21/44; F41C 23/16

USPC ..... 89/14.1

See application file for complete search history.

(56) References Cited

U.S. PATENT DOCUMENTS

| | | | | |
|---|---|---|---|---|
| 1,004,666 A | | 10/1911 | Lewis | |
| 1,328,230 A | * | 1/1920 | Johnston | F41A 9/35 89/1.1 |
| 1,527,585 A | * | 2/1925 | Hamilton | F41A 13/10 89/14.1 |

(Continued)

FOREIGN PATENT DOCUMENTS

| | | | | |
|---|---|---|---|---|
| DE | 319915 C | * | 4/1920 | F41A 13/10 |
| GB | 197527 A | * | 5/1923 | F41A 13/10 |

OTHER PUBLICATIONS

Navin r, "Idea: handguard w/ cooling fans built in", May 12, 2015, Calguns.net, entire thread especially post #1, <http://www.calguns.net/calgunforum/showthread.php?t=1071483>, accessed Aug. 7, 2017.*

(Continued)

*Primary Examiner* — Jonathan C Weber

(74) *Attorney, Agent, or Firm* — Dinsmore & Shohl LLP

(57) ABSTRACT

A heat dissipation assembly for use with a barrel forming a part of a firearm upper receiver. An annular shaped barrel nut is adapted to secure the barrel to the upper receiver. An elongated handguard is affixed to the barrel nut at a heat conducting location, the handguard adapted to surround a proximal extending portion of the barrel, the handguard having a plurality of apertures defined therethrough. At least one cooling element is located on an exterior of the handguard. A thermoelectric generator is incorporated into the handguard for transferring heat from the barrel nut to the cooling element. A fan component is integrated into the handguard and operated by the thermoelectric generator for drawing air through the apertures in order to provide additional cooling to the barrel.

19 Claims, 11 Drawing Sheets

(56) References Cited

U.S. PATENT DOCUMENTS

| | | | | |
|---|---|---|---|---|
| 4,982,648 | A * | 1/1991 | Bol | F41A 13/12 42/76.02 |
| 5,117,734 | A * | 6/1992 | Rhoads | F41A 13/10 89/1.2 |
| 5,590,484 | A | 1/1997 | Mooney et al. | |
| 5,726,375 | A * | 3/1998 | Adams | F41A 13/00 89/14.1 |
| 6,095,236 | A | 8/2000 | Kuhler | |
| 6,508,159 | B1 | 1/2003 | Muirhead | |
| 6,679,156 | B1 * | 1/2004 | Danou | F41A 5/06 89/14.1 |
| 6,705,195 | B1 * | 3/2004 | Thornton | F41A 13/10 89/14.1 |
| 6,827,130 | B2 | 12/2004 | Larson | |
| 7,013,592 | B2 | 3/2006 | Olson et al. | |
| 7,464,496 | B1 | 12/2008 | Davies et al. | |
| 7,563,097 | B2 * | 7/2009 | Lavigna | F41C 23/16 42/124 |
| 7,997,020 | B2 | 8/2011 | Brixius | |
| 8,448,367 | B2 | 5/2013 | Samson et al. | |
| 8,615,916 | B2 | 12/2013 | Bassoli et al. | |
| 8,726,559 | B1 | 5/2014 | Mueller | |
| 8,763,509 | B1 * | 7/2014 | Nagel | F41A 13/10 261/152 |
| 8,783,154 | B1 * | 7/2014 | Windham | F41A 13/12 89/14.1 |
| 9,207,031 | B2 | 12/2015 | Balthaser et al. | |
| 9,435,600 | B2 * | 9/2016 | Oliver | F41A 13/12 |
| 2003/0010187 | A1 | 1/2003 | Muirhead | |
| 2004/0094025 | A1 * | 5/2004 | Meissner | F41A 13/10 89/14.1 |
| 2007/0039224 | A1 * | 2/2007 | Skinner | F41A 29/00 42/106 |
| 2013/0061503 | A1 | 3/2013 | W. et al. | |
| 2014/0082990 | A1 | 3/2014 | Lee | |

OTHER PUBLICATIONS

Durham68, "BIT: Battery Powered AR-15 Cooling Fan", Apr. 29, 2010, The Gun Counter, entire thread especially post #1, <http://www.theguncounter.com/forum/viewtopic.php?t=11653>, accessed Aug. 7, 2017.*

* cited by examiner

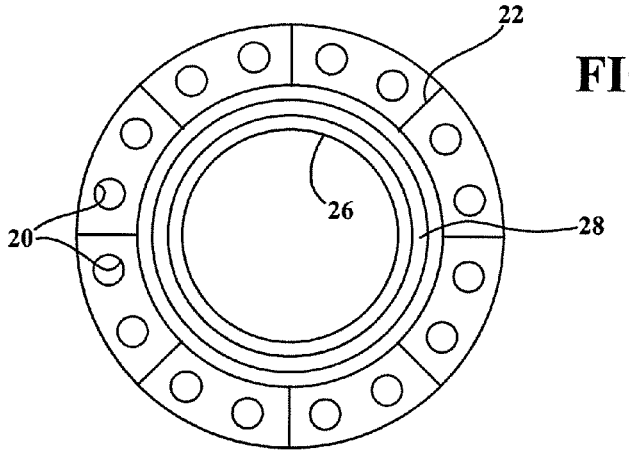
FIG. 1
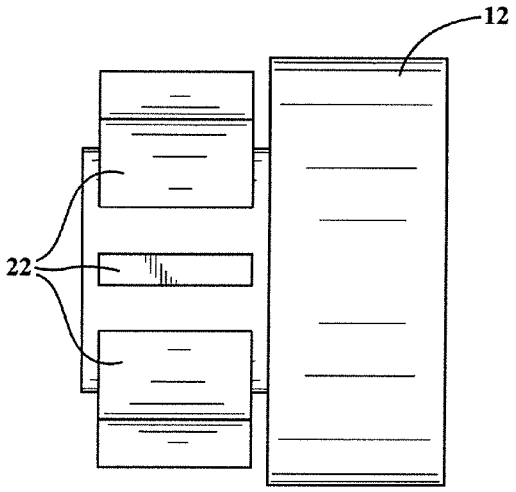
FIG. 2
FIG. 3
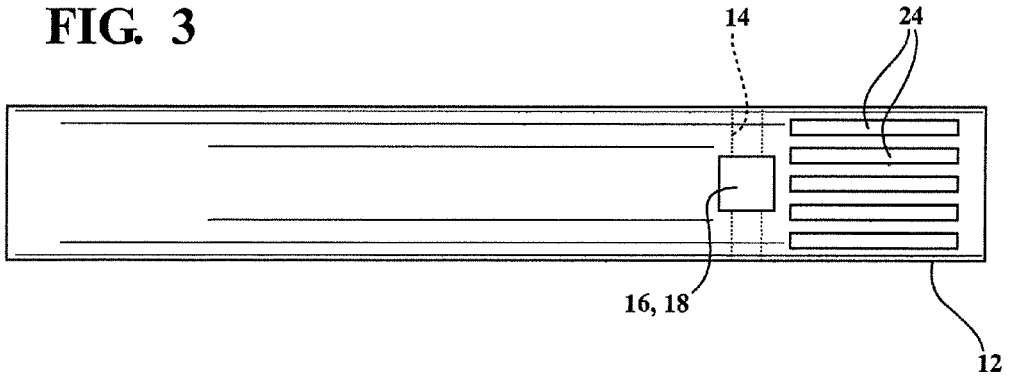

FIG. 4
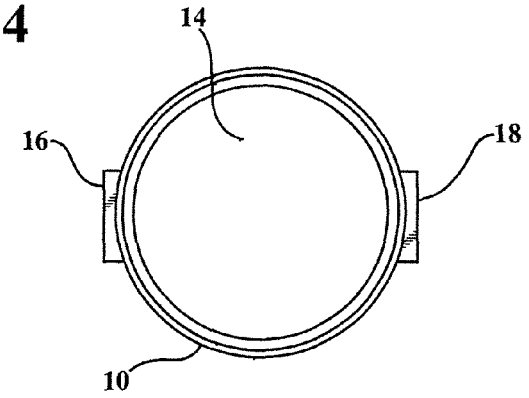
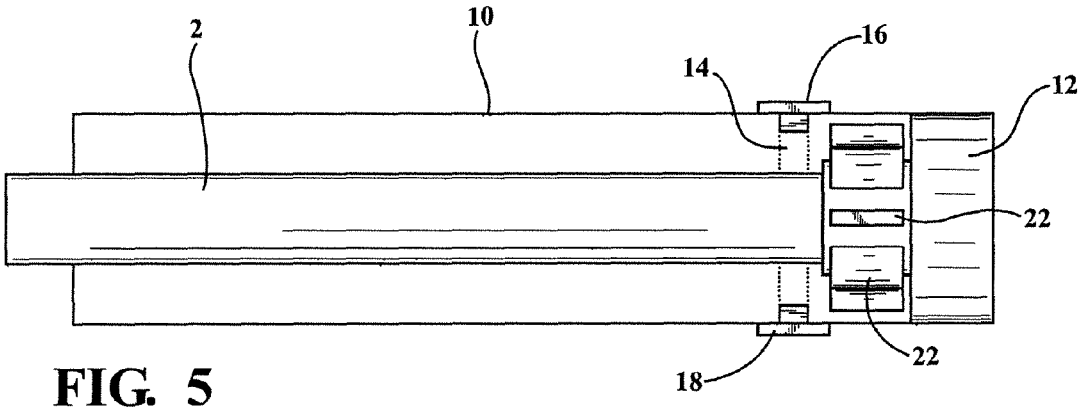
FIG. 5
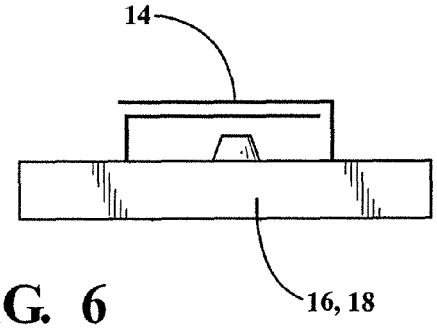
FIG. 6

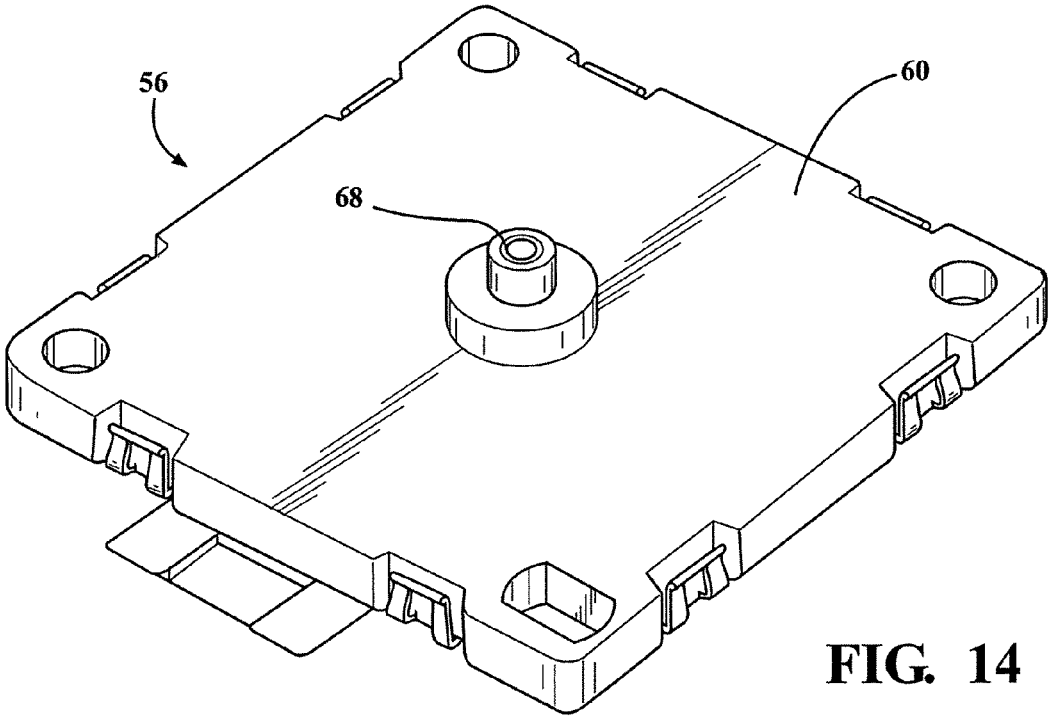
FIG. 14
FIG. 15
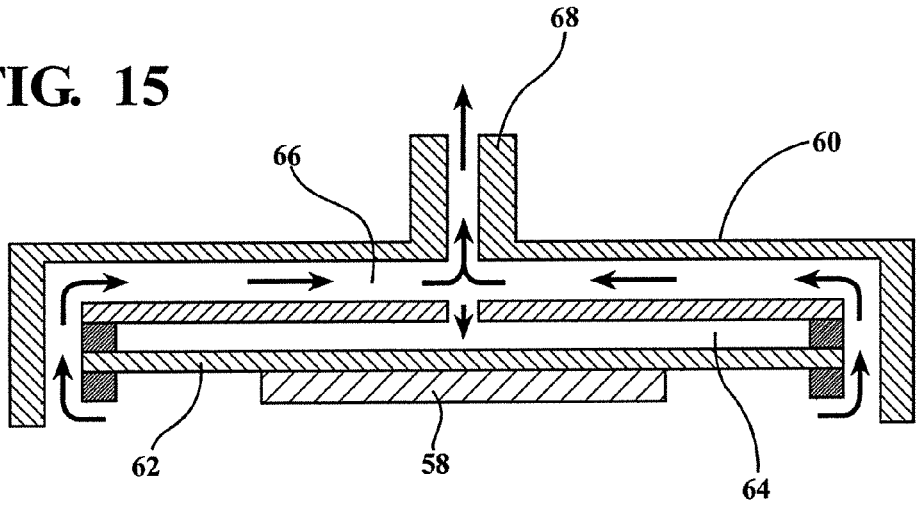

HEAT DISSIPATION ASSEMBLY INCORPORATED INTO A HANDGUARD SURROUNDING A RIFLE BARREL

CROSS-REFERENCE TO RELATED APPLICATIONS

This Application claims the benefit of U.S. Provisional Application 62/171,303 filed on Jun. 5, 2015, the contents of which is incorporated herein in its entirety,

FIELD OF THE INVENTION

A rifle hand guard assembly incorporating heat dissipating structure in the form of a thermo-electric generator utilizing a Seebeck module arranged between a heat sink and cooling block and which absorbs heat emanating from the rifle barrel. In a first variant, the module powers a piezoelectric blower which in turn integrates an inner diaphragm, piezoelectric element and pump in order to create an airflow through a nozzle for in turn driving a circular air blade integrated into an elongated tube mounted over the rifle barrel.

In a second variant, a fan is substituted for the piezoelectric blower and the circular blade substituted by a vortex effect created by intake flow patterns created by the fan which facilitates wicking away of heat from the barrel, via the handguard incorporated hot plate to the exteriorly supported cooling plates. An air tube is attached directly to an interior of the handguard, in abutting contact with the barrel nut. The air tube exhibits a plurality of slot configured on its abutting end face which causes the airflow to be rotated and compressed in a torsionally directed fashion around the barrel separate from the heat transfer from the barrel nut to the hot plate.

In operation, the assembly converts the emanating heat from the barrel to either of the piezo-blower operated rotary fan or air blade, which operates to both discharge heat emanating from the barrel as well as to draw, via forced convention in the one variant or torsionally generated airflow in the other variant, a cooling airflow to assist in preventing overheating of the barrel. Air intake vents formed in the hand guard overlap the fins for assisting in convection resulting from pulling of the cooling air over the fins.

BACKGROUND OF THE INVENTION

The prior art is documented with examples of heat dissipation, or heat sinking, assemblies for use with a firearm barrel. As is known, repeated discharge of rounds in either of semi-automatic or automatic firing modes results in rapid heating of the barrel to an excessive degree, resulting in the requirement to provide for cooling of the barrel to prevent damage or a misfiring condition.

A first example is disclosed in the heat sink rail system of Lee, US 2014/0082990 which teaches passing air through fins configured in the rail system, such further adapted for mounting other accessories. The fins can be configured either axially along the barrel or in either of inwardly or outwardly extending fashion relative to the rail system.

A further example is shown in Samson, U.S. Pat. No. 8,448,367 which teaches a modular fore-end rail assembly for mounting onto a firearm which includes a hand guard and a bushing element that combines with an end portion of the hand guard to encircle a standard barrel nut. The material construction facilitates heat transfer from the barrel nut to the hand guard at an adjusted rate such that rapid changing of the bushing elements changes the heat rate of the hand guard.

Other relevant examples include each of the firearm heat sink of Muirhead, U.S. Pat. No. 6,508,159, the heat removal system of Larson, U.S. Pat. No. 6,827,130, the fin-type heat exchanger of Price, WO 84/04432, the universal barrel nut for a firearm of Mueller, U.S. Pat. No. 8,726,559, and the heat exchanger barrel nut of Davies et al., U.S. Pat. No. 7,464,496.

SUMMARY OF THE INVENTION

As previously described, the present invention discloses a rifle hand guard assembly incorporating heat dissipating structure in the form of a thermo-electric generator utilizing a Seebeck module arranged between heat sink and cooling block aspects of a handguard and associated barrel nut for absorbing heat emanating from the rifle barrel. In a first variant, the module powers a piezoelectric blower which in turn integrates an inner diaphragm, piezoelectric element and pump in order to create an airflow through a nozzle for in turn driving a circular air blade integrated into an elongated tube mounted over the rifle barrel.

In a second variant, a fan is substituted for the piezoelectric blower and the circular blade substituted by a vortex effect created by intake flow patterns created by the fan which facilitates wicking away of heat from the barrel, via the handguard incorporated hot plate to exteriorly supported cooling plates. An air tube is attached directly to an interior of the handguard, in abutting contact with the barrel nut. The air tube exhibits a plurality of slot configured on its abutting end face which causes the airflow to be rotated and compressed in a torsionally directed fashion around the barrel separate from the heat transfer from the barrel nut to the hot plate.

In operation, the assembly converts the emanating heat from the barrel to either of the piezo-blower operated rotary fan or air blade, which operates to both discharge heat emanating from the barrel as well as to draw, via forced convention in the one variant or torsionally generated airflow in the other variant, a cooling airflow to assist in preventing overheating of the barrel. Air intake vents formed in the hand guard overlap the fins for assisting in convection resulting from pulling of the cooling air over the fins.

BRIEF DESCRIPTION OF THE DRAWINGS

Reference will now be made to the attached drawings, when read in combination with the following detailed description, wherein like reference numerals refer to like parts throughout the several views, and in which:

FIG. 1 is a cutaway end view of a concentric arrangement of an end mounted barrel nut associated with a first embodiment the present assembly and including an inner most aluminum heat sink layer, intermediate Seebeck Module layer and outermost cooling block layer incorporating circumferentially arrayed pluralities of ventilation holes and heat dissipation fins;

FIG. 2 is a rotated end view of the barrel nut;

FIG. 3 is an assembly view of the elongated hand guard and barrel nut with interposed piezoelectric blower and circular air knife and further depicting the arrangement of air intake vents overlapping the finned cooling block;

FIG. 4 is a cutaway view of the circular air knife in FIG. 3 and better illustrating the dual inward direction of the cooling airflows generated by the piezoelectric blower;

FIG. 5 is a ninety degree rotated and lengthwise cutaway of FIG. 3 and which illustrates the arrangement of components contained within each of elongated handguard, cooling block and end situated aluminum barrel nut;

FIG. 6 is a sectional illustration of the internal air knife and piezoelectric blower;

FIGS. 14-15 illustrate perspective and side cutaway views of the piezoelectric element, pump and air knife nozzle;

DETAILED DESCRIPTION OF THE PREFERRED EMBODIMENTS

As previously described, the present invention discloses a rifle hand guard assembly incorporating heat dissipating structure, such as in the form of a thermo-electric generator utilizing a Seebeck module arranged between a heat sink and cooling block and which absorbs heat emanating from the rifle barrel. As will be further described with reference to the appended illustrations, the module powers a piezoelectric blower which in turn integrates an inner diaphragm, piezoelectric element and pump in order to create an airflow through a nozzle for in turn driving a circular air blade integrated into an elongated tube mounted over the rifle barrel.

The tube (also termed a free floating handguard) is mounted in thermally conducting fashion with the rifle barrel and is in contact with cooling fins arranged on an end assembled cooling block, the fins being arrayed in circumferential and linearly extending fashion around an attached barrel nut for converting the emanating heat from the barrel to a redirected cooling airflow to assist in preventing overheating of the barrel. Air intake vents formed in the hand guard overlap the fins for assisting in forced convection resulting from pulling of the cooling air over the fins.

Referring initially to FIGS. 1-6, a series of diagrammatic views are shown of one non-limiting hand guard assembly incorporating thermoelectric generation technology for converting the heat emanating of the rifle barrel into an electrical output for driving a piezoelectric blower for in turn rotating a circular blade integrated into the free float tube and in order to provide constant cooling of the barrel. Without limitation, the present invention contemplates a hand guard assembly which can be configured for mounting over a variety of different firearms. Both the free float tube 10 and barrel nut 12 can be constructed of any suitable heat dissipating and conducting materials, such as aluminum.

Figure 8:
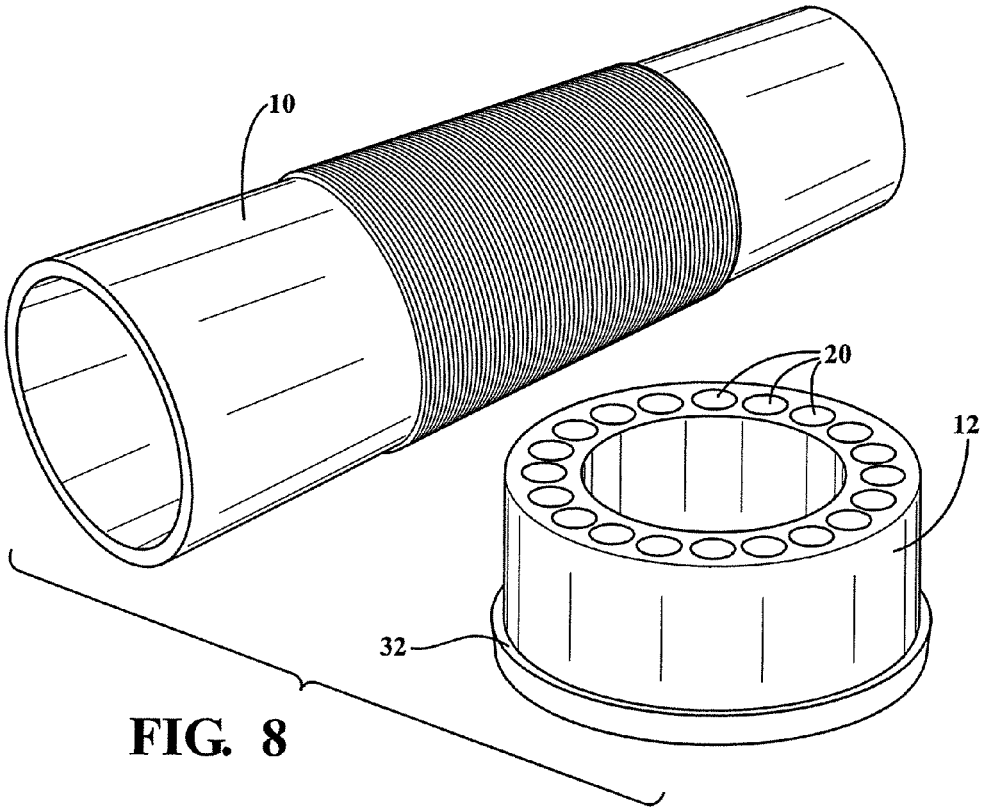
FIG. 8 is a disassembled illustration of the free float hand guard and illustrating the two piece construction of the barrel nut and free float tube with knurled exterior surface.

As best shown in each of FIGS. 5 and 8, the assembly according to the illustrated embodiment includes an elongated and free float tube 10 and an end attachable barrel nut 12, each typically incorporating a generally polygonal or circular shape in cross section and which is configured to include inner apertures for mounting about the barrel (at 2 in FIG. 5) of the firearm. Although not clearly shown, the free float tube 10 also incorporates a circular air knife 14 (also termed a rotatable blade) at a proximal end thereof in proximity to the end-attachable barrel nut 12. To this end, reference to known air blade designs (such as incorporated into conventional vacuum cleaners) is referenced in FIG. 16 and which is capable of being integrated into the free float tube for maximizing a desired rotational speed and airflow generated output in response to the piezo-element generated blower input.

A pair of piezoelectric blowers 16 and 18 are illustrated arranged at opposing circumferential access locations in the tube 10 (see again FIG. 5) in which the blowers direct concentrated airflows, via their nozzles, for jointly rotating the circular air knife blades. Additional features associated with the barrel nut 12 include a circumferentially extending array of ventilation holes 20 in combination with a likewise circumferentially extending array of cooling block fins 22. As further depicted in FIG. 3, a further plurality of air intake vents 24 are arranged about the circumference of the barrel nut 12 and which overlap the fins 22 of the cooling block, this in order to enhance the forced convection which occurs upon the cool air being pulled over the fins 22 in a radiator like fashion.

FIG. 1 further illustrates in cutaway end view a concentric arrangement of the end mounted barrel nut 12 associated with the present assembly and including an inner most aluminum heat sink layer 26, intermediate Seebeck Module layer 28 and outermost cooling block layer incorporating the circumferentially arrayed pluralities of ventilation holes 20 and heat dissipation fins 22. FIG. 2 is a rotated end view of the barrel nut 12 and better depicting the arrangement of the cooling block fins 22 relative to the base portion of the end nut 12, within which are configured the ventilation holes 20.

FIG. 3 is an assembly view of the elongated hand guard 10 and barrel nut 12 with interposed piezoelectric blowers 16/18 and circular air knife 14 and further depicting the arrangement of air intake vents 24 overlapping the finned cooling block. FIG. 4 is a cutaway view of the circular air knife in FIG. 3 and better illustrating the dual inward direction of the cooling airflows generated by the piezoelectric blowers 16 and 18 according to one non-limiting arrangement which further contemplates any number or arrangement of piezoelectric blowers in any configuration desired. FIG. 5 is a ninety degree rotated and lengthwise cutaway of FIG. 3 and which illustrates the arrangement of components contained within each of elongated handguard, cooling block and end situated aluminum barrel nut, with FIG. 6 providing a sectional illustration of the internal air knife 14 and piezoelectric blower 16/18.

Figure 7:
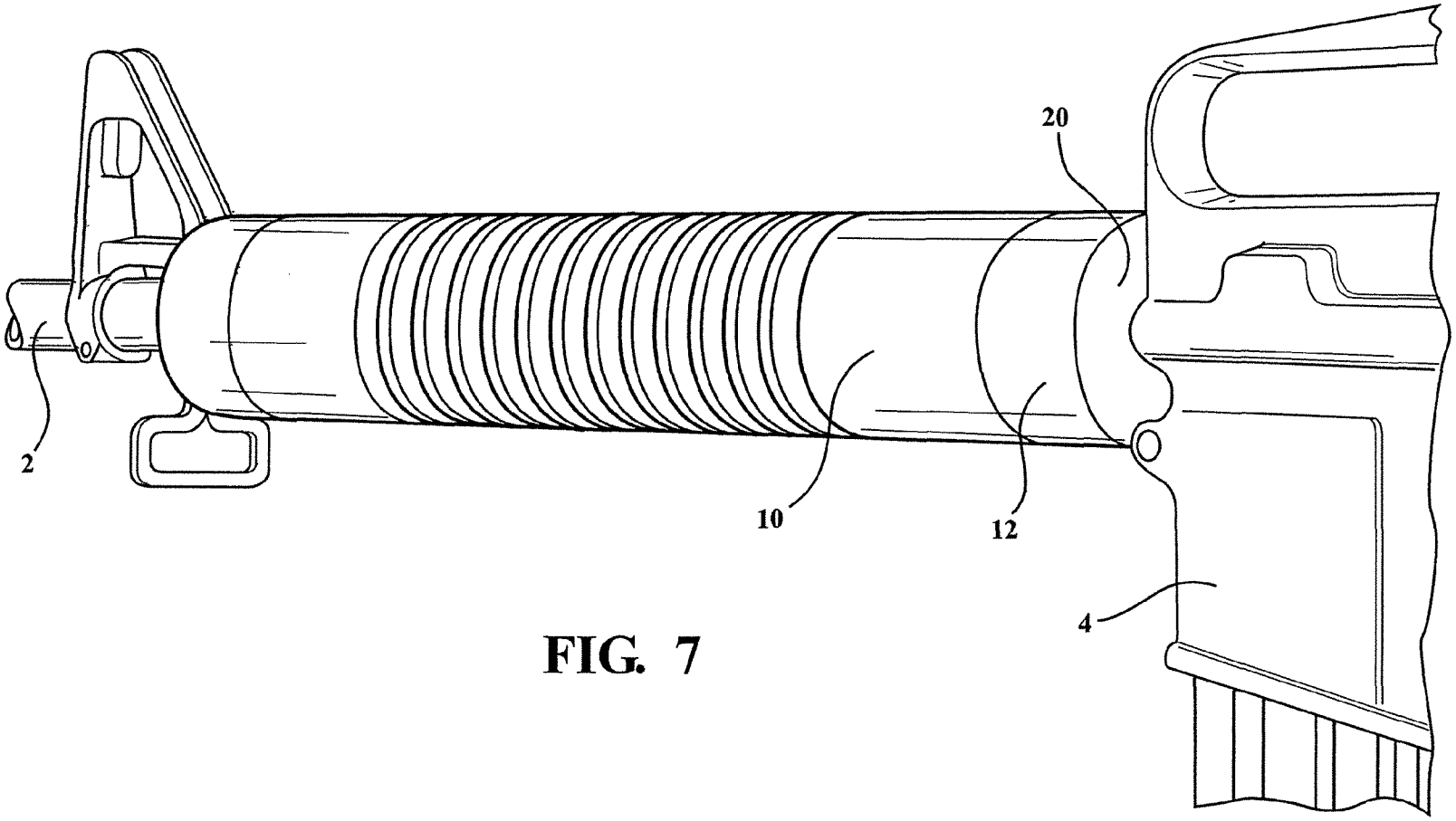
FIG. 7 is an environmental illustration of a free floating handguard associated with an AR-15 rifle according to one non-limiting variant of the present inventions.

With further reference to the environmental illustration of FIG. 7, a free floating handguard assembly is shown associated with an AR-15 rifle according to one non-limiting variant of the present inventions. This again includes a main tubular body 10 with innermost heat sink layer overlaying the barrel 2 of the conventional rifle 4, as well as the threaded end nut 12 attached to the proximal end of the body 10 and which exhibits the circumferential array of ventilation holes 20 disposed about a communicating rear end of the nut for venting the heat generated by the barrel.

FIG. 8 is a disassembled illustration of the free float hand guard and illustrating the two piece construction of the barrel nut 12 and free float tube 10, such further exhibiting a knurled exterior surface 30. Not clearly shown is the internal rotating air blade which is configured within the tube 10 in a manner and location consistent with the schematic cutaway of FIG. 5. Also shown in FIG. 8 with regard to the bearing nut 12 is the circumferential array of ventilation holes 20 as well as the threaded annular side 32, this rotatably inter-engaging with mating threads associated with a given engaging end of the tube 10.

Figure 9:
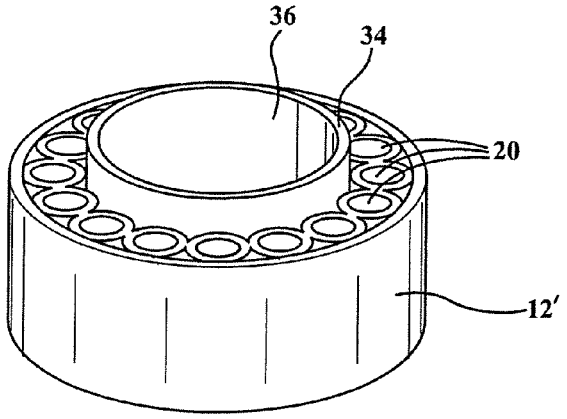
FIG. 9 is a perspective of a variation of barrel nut with ventilation hole pattern and annular extending nose.

FIG. 9 is a perspective of a variation of barrel nut 12' with ventilation hole pattern, again at 20, and an annular extending nose or lip 34. A plurality of threads 36 are further depicted upon an interior annular wall of the nut 12' for inter-engaging a suitably configured end of the main tube 10.

Figure 10:
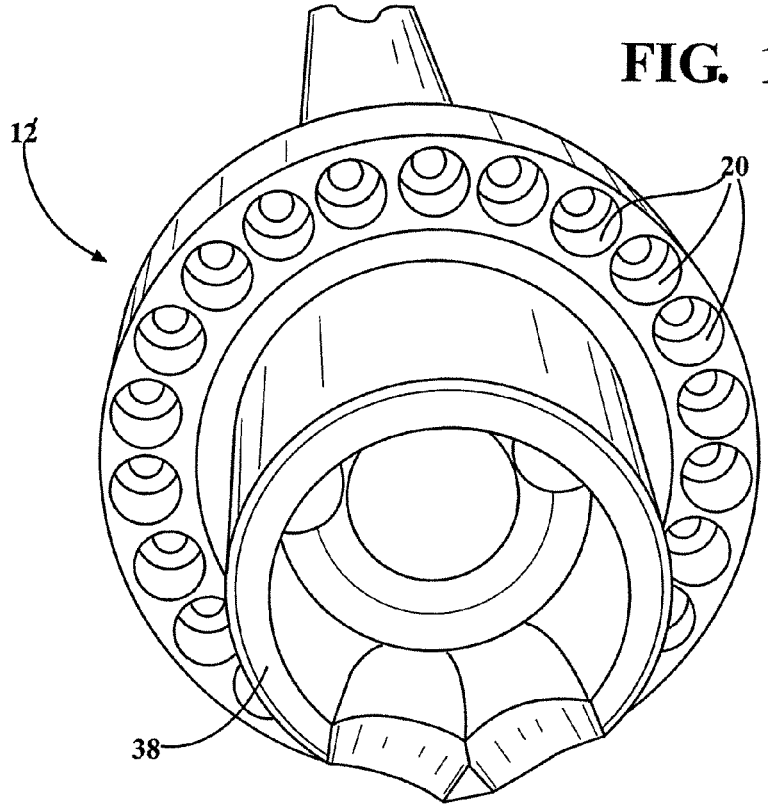
FIG. 10 is a succeeding end view perspective illustration to FIG. 9 of the barrel nut and barrel for attachment of the thermoelectric generator.

FIG. 10 is a succeeding illustration to FIG. 9 of the mounting location 38 for receiving the thermoelectric generator attached to the barrel nut 12'. As is known, a thermoelectric generator (also called a Seebeck generator) is a device which converts heat (defined as a temperature differential) directly into electrical energy, this utilizing a phenomenon called the Seebeck effect which operates under the principle that a thermal gradient famed between two dissimilar conductors produces a voltage.

Figure 11:
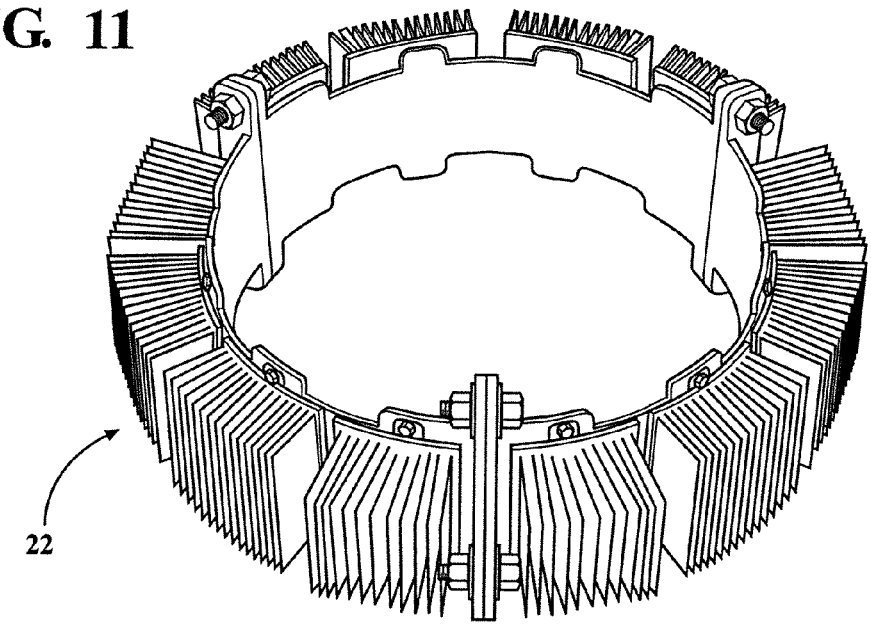
FIG. 11 is an illustration of a non-limiting variant of annular arrayed cooling fins which can be integrated into the cooling block.

FIG. 11 is an illustration of a non-limiting variant of annular arrayed cooling fins, such as previously depicted at 22, and which can be integrated into the cooling block. As previously described with reference to the diagrammatic views of FIGS. 1-6, the fins 22 assist in drawing the heat generated by the rifle barrel 2, via the inner aluminum heat sink layer 26.

Figure 12:
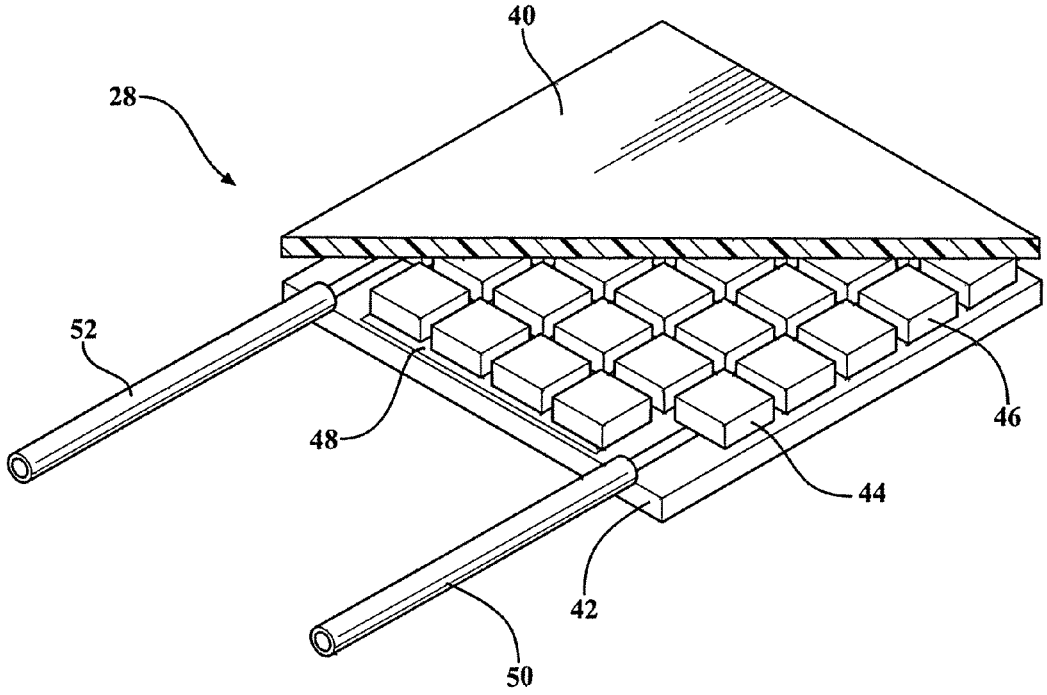
FIG. 12 is a partial cutaway view in sectional perspective of a Seebeck Module associated with the thermoelectric generator.

FIG. 12 is a partial cutaway view in sectional perspective of a Seebeck Module, such as associated with layer 28 in FIG. 1, associated with the thermoelectric generator. As shown, this module creates the heat engine between the heat sink and cooling block and includes upper 40 and lower 42 ceramic substrate layers. Alternating N-type 44 and P-type 46 are arrayed in grid supported fashion upon conductor tabs 48 arranged between the substrate layers 40 and 42, with positive 50 and negative 52 leads extending to electrically communicating edge locations of the module 28.

As previously described, the Seebeck effect is used in thermoelectric generators, which function like heat engines, but are less bulky, have no moving parts, and are typically more expensive and less efficient. The thermoelectric effect is the direct conversion of temperature differences to electric voltage and vice versa.

As is also known, a thermoelectric device creates voltage when there is a different temperature on each side. Conversely, when a voltage is applied to it, it creates a temperature difference. At the atomic scale, an applied temperature gradient causes charge carriers in the material to diffuse from the hot side to the cold side. This effect can be used to generate electricity, measure temperature or change the temperature of objects. Because the direction of heating and cooling is determined by the polarity of the applied voltage, thermoelectric devices can also be used as temperature controllers.

Figure 13:
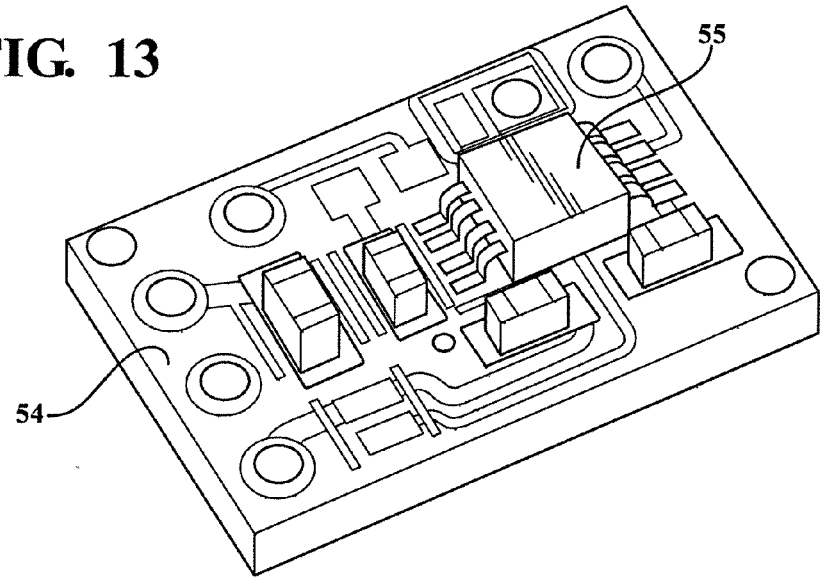
FIG. 13 illustrates a Seebeck Module type piezoelectric blower incorporated into the present assembly.

With the above explanation, FIG. 13 further illustrates a piezoelectric blower, such as previously shown at 16/18 in the diagrammatic views of FIGS. 1-6, incorporated into a circuit board 54 with processor 55 and associated support components. In this fashion, the thermoelectric generating barrel nut (12 or 12') powers each of the piezoelectric blowers utilized.

FIGS. 14-15 illustrate perspective and side cutaway views of the piezoelectric element, pump and air knife nozzle, all of which are incorporated into a subset assembly 56 in communication with the board assembly 54 of FIG. 13, the assemblies 56 each being arrayed in the manner depicted diagrammatically at 16 and 18 in FIG. 1-6. As best shown in the side cutaway assembly of FIG. 15, a piezoelectric element 58 is integrated into an interior of a generally three dimensional square or rectangular shaped housing 60 and forms a part of an inner diaphragm 62, in turn creating an inner pump 64.

Applying the Seebeck effect principles previously described, an airflow is created in an intake channel 66 which collects and accelerates the interior airflow for delivery through upper end nozzles 68. An intake replacement airflow is further created by drawing through the air intake vents 24 of FIG. 3 which are again understood to overlap the finned cooling block portion of the barrel nut and, in this fashion, creates a forced convection affect by pulling the cool intake air over the fins in a radiator like fashion. As further previously described, the piezoelectric blowers are arranged in any desired pattern around the periphery of the outer hand guard in proximity to the circular rotating air blade which is supported within the interior of the free float tube 10 at the engagement location with the barrel nut 12.

Figure 16:
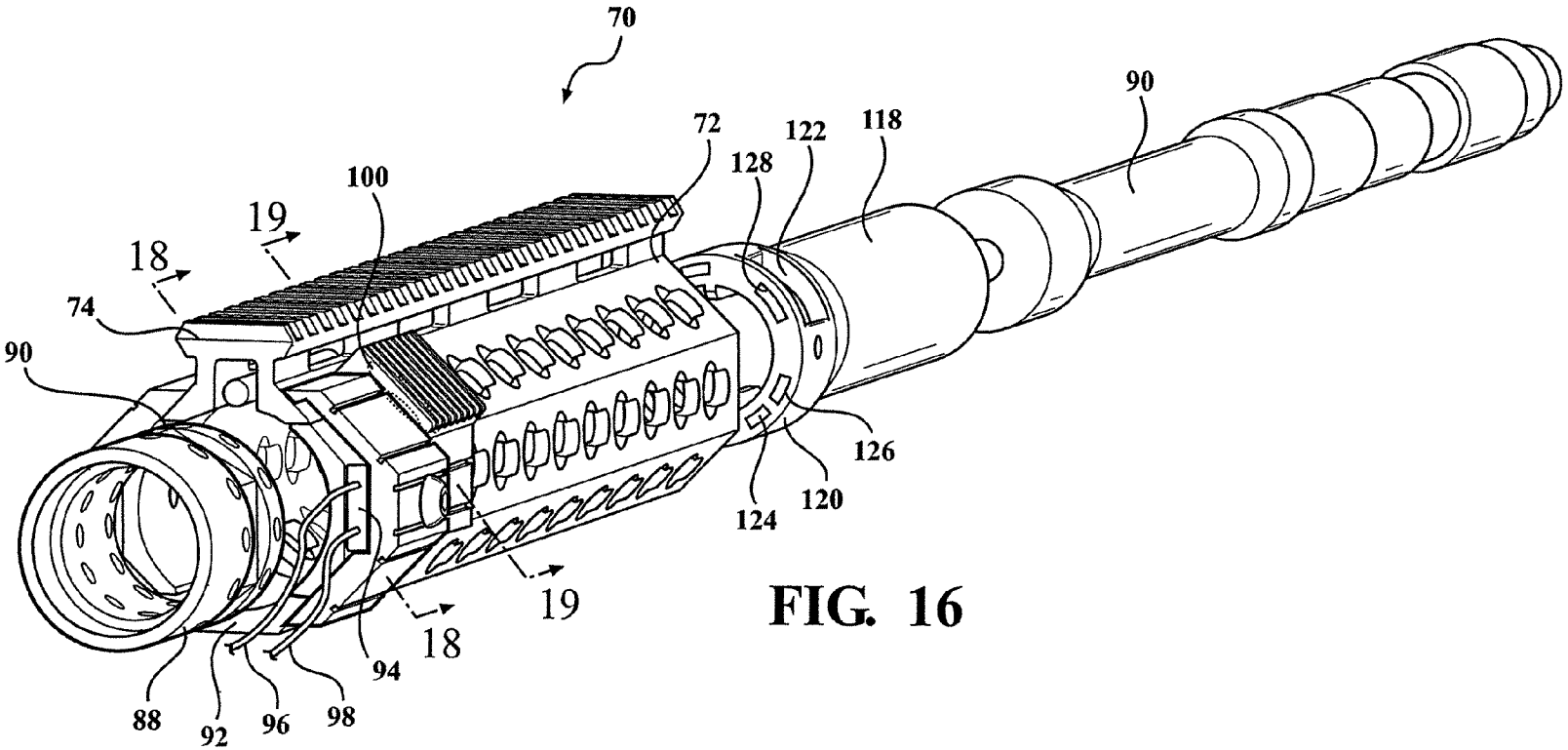
FIG. 16 is a partially exploded perspective of a hand guard assembly according to a second non-limiting embodiment incorporating heat dissipating aspects.

Referring collectively to FIGS. 16-20, and initially to FIG. 16, a partially exploded perspective is shown at 70 of a hand guard assembly according to a second non-limiting embodiment incorporating heat dissipating aspects. Along with the enlarged exploded perspective of FIG. 17, the assembly 70 includes a hand guard body 72 exhibiting a generally cylindrical and elongated body and further depicting an upper mounting rail 74, such further referenced as a Picatinny style rail.

Figure 17:
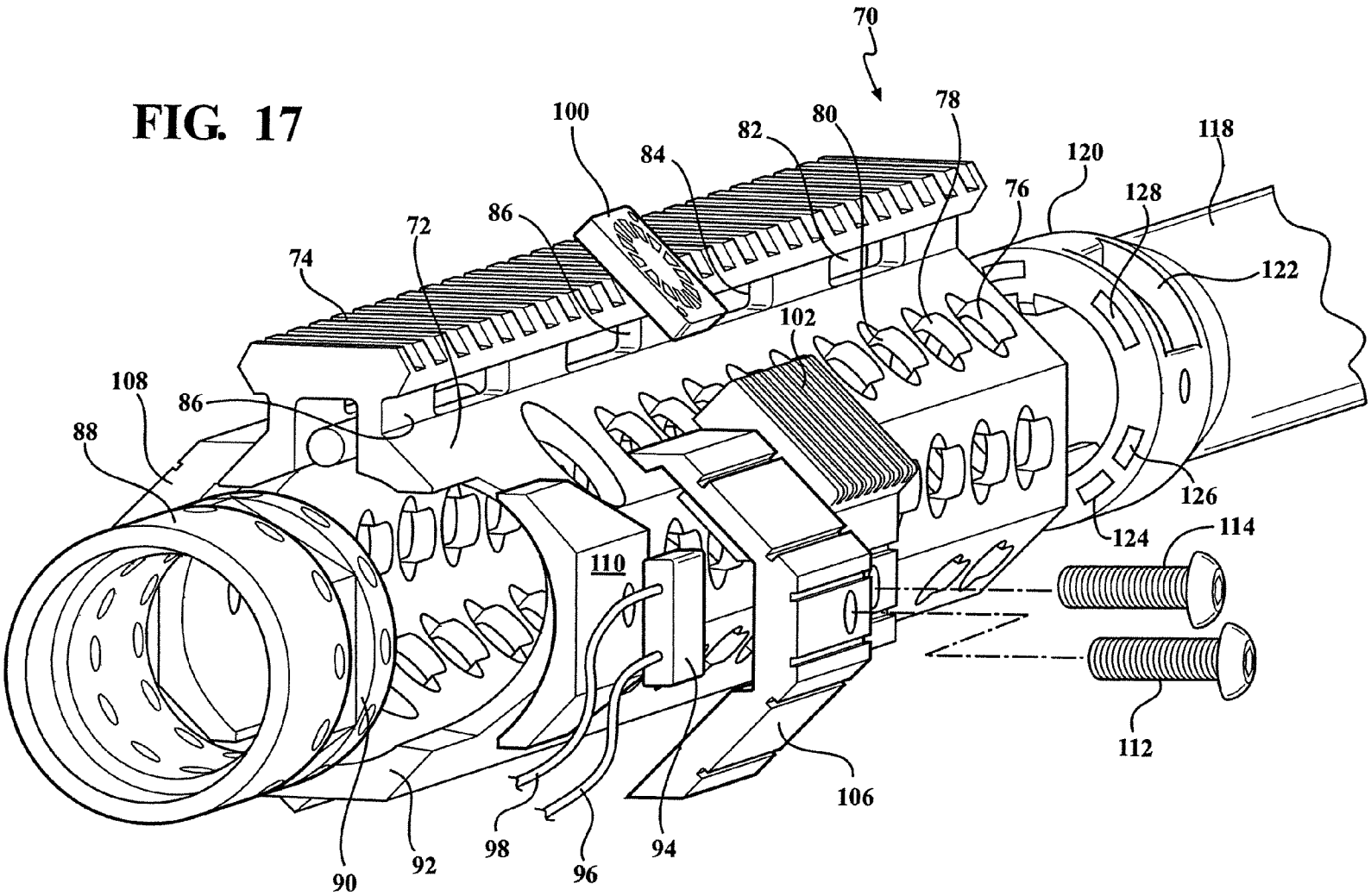
FIG. 17 is an enlarged exploded perspective of the hand guard integrated into the assembly and including each of a customized barrel nut, handguard integrated hot plate, thermoelectric generator (TEG), outer cooling fins/plates, TEG operated fan and interiorly positioned and barrel nut abutting air tube for facilitating torsionally induced airflow over and along the barrel.
Figure 18:
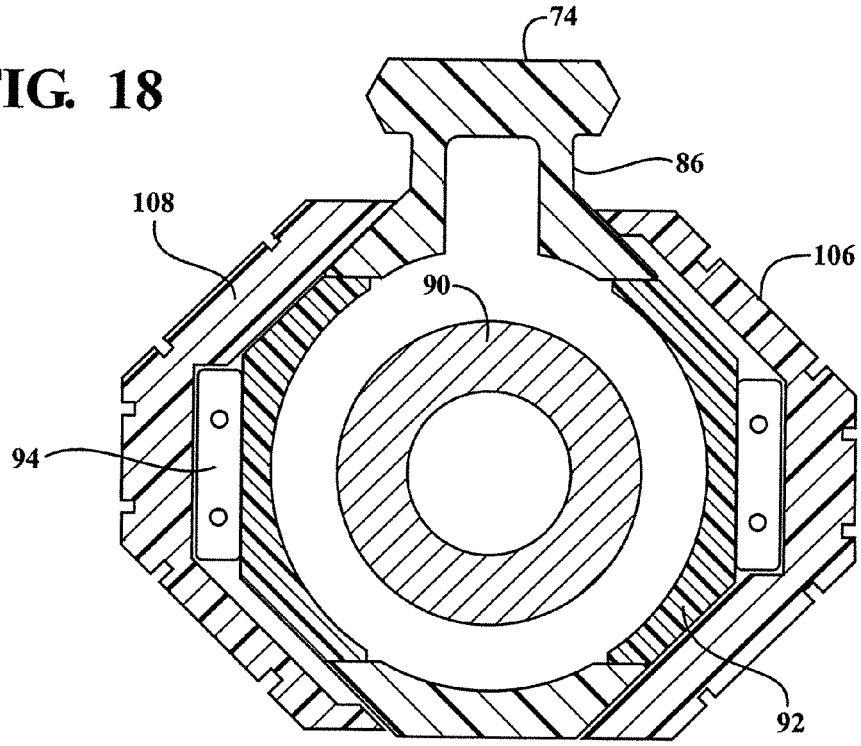
FIG. 18 is a first cross sectional cutaway taken along line 18-18 of FIG. 16 and depicting the arrangement of the interiorly positioned hot plate, thermoelectric generator, and outer cooling fins or plate.

As further best shown in FIG. 17, the hand guard body 72 includes pluralities of inner perimeter defined apertures 76, 78, 80, et seq. formed in spaced fashion along its length, and further such as in distributed arrangement along each of octagonal style interconnected sides as further depicted in cross section. Additional perimeter defined apertures are further shown at 80, 82, 84 extending in spaced fashion along a mounting neck 86 underneath the uppermost mounting rail 74. Without limitation, the shape and configuration of the handguard can be modified from that shown and which is illustrative only of one possible embodiment of its design.

A customized (typically aluminum) barrel nut 88 is provided for securing the firearm barrel, further shown at 90 in this variant, to the firearm upper receiver (not shown). The barrel nut 88 includes an circumferentially projecting forward end 90 and attaches to the handguard body 72 for securing the same to the upper receiver. As further shown, the barrel nut can include additional aperture patterns in circumferentially distributed fashion along either of its main body 88 or integrated forward projecting end 90.

Figure 20:
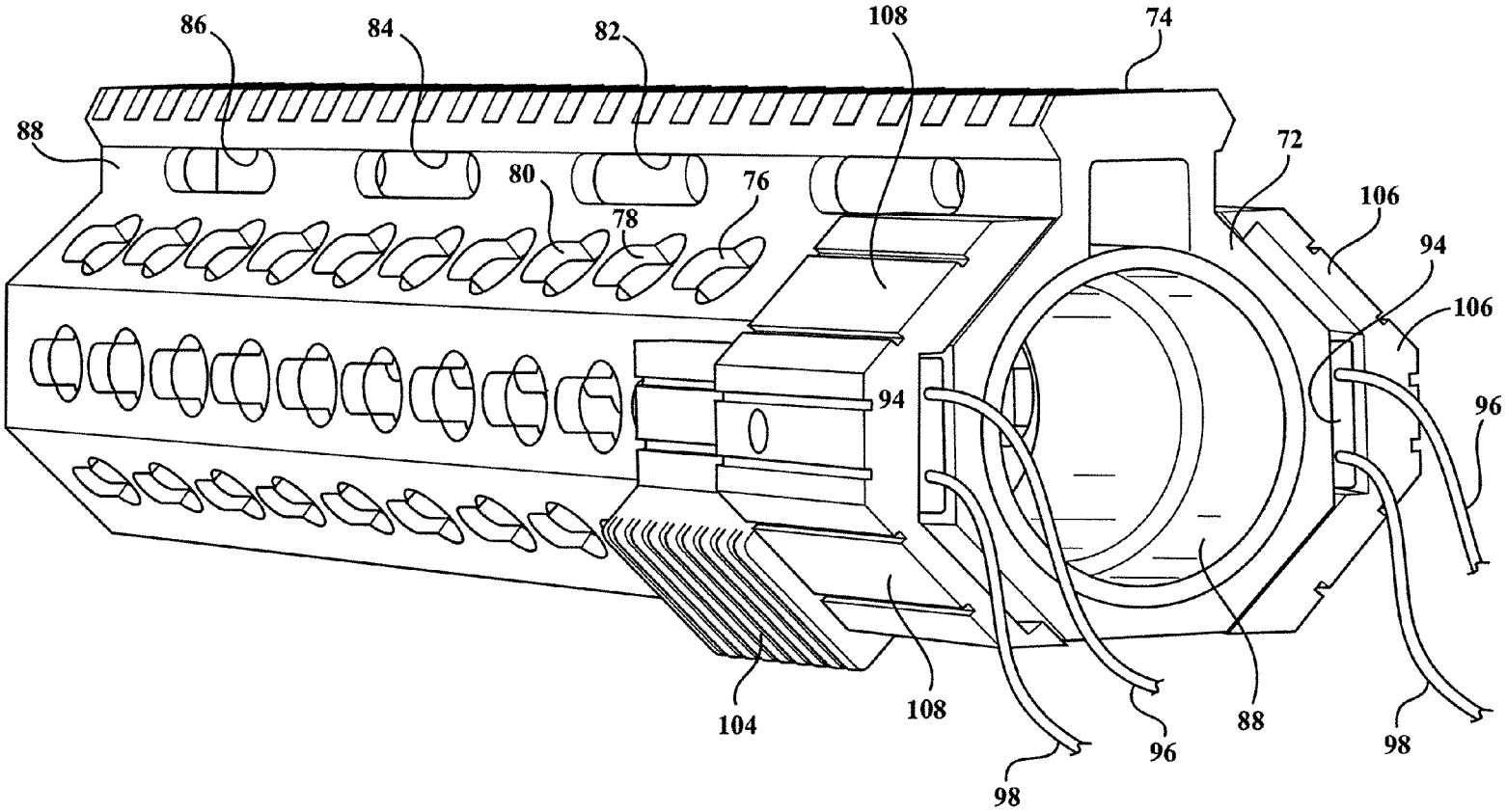
FIG. 20 is a reverse side perspective of the hand guard assembly removed from the barrel and depicting the wires extending from the thermoelectric generator for operating the fan.

The handguard body, see as depicted at location 92, is typically constructed of a metal for collecting the heat of the barrel nut 88, via conductivity, and further operates as a hot side for driving a reconfigured thermoelectric generator (TEG) 94, similar to that depicted at 28 in FIG. 12. As shown in FIG. 20, such generators are typically provided in paired fashion at opposite rear proximate sides of the handguard in proximity to the barrel nut 88, the TEGs 94 each including a pair of wires 96 and 98 in communication with and for driving one or more fan components 100.

The fan component 100 is seated within a pocket configured within a finned cooling block 102 exhibited on an upper first side of the handguard 72 (see opposite lower side cooling block 104 with fins in FIG. 20). As understood, the cooling blocks 102/104 integrate elongated apertures, between which are positioned the finned surfaces of the blocks, and which are in communication with the interior pockets within which the fan components 100 are seated, In this fashion and, upon activation of the fan by the wires extending from the TEG, this causes the drawing in of air flow through the cooling block fins which is then communicated to the handguard interior via the slots 76, 78, 80 et seq. configured therethrough.

A pair of cooling plates 106 and 108 are also provided, each including in the non-limiting depicted embodiment a multi-sided (such as shown by three sided) and inter-angled configuration which is mounted to an exterior surface location (see at 110 in FIG. 17) of the handguard 72 via screws (at 112). The finned cooling blocks 102/104 and cooling plates 106/108 are examples of cooling elements located upon the exterior of handguard and it is envisioned that these can be reconfigured or repositioned as desired. As further shown, additional screws (at 114) are likewise provided for securing a base location (see at 116 for specific cooling block 102 in FIG. 17) of each upper side or lower side positioned cooling block 102 or 104, and for mounting the same to the handguard in proximate forward position relative to the cooling plates.

An air tube 118 is provided which is secured within the interior of the handguard body 72 in abutting fashion against a forward end of the barrel nut 88. The air tube includes an annular projecting inner end 120, this further integrating an arcuate side extending passageway 122 which aligns underneath with the fan component 100. Additional torsionally directed airflow passageways are further configured within the air tube 118 (see as represented at 124, 126, 128, et. seq.) these being in communication with the side disposed air passageway 122.

Figure 19:
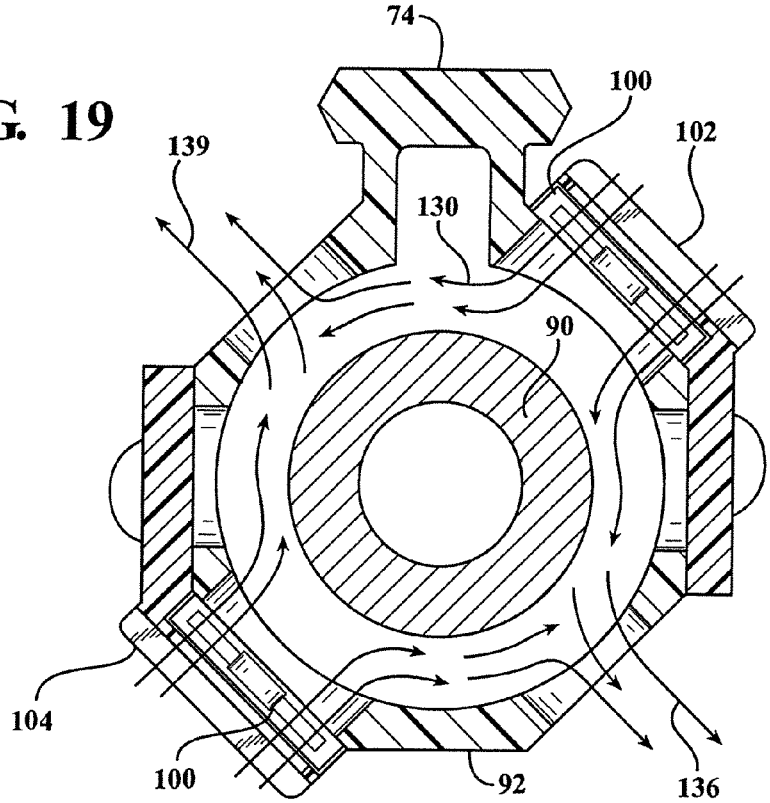
FIG. 19 is a second cross sectional cutaway taken along line 19-19 of FIG. 16 and showing the TEG activated fan for drawing air in through the cooling block and subsequently redirecting fluid flow in a compressed and torsional/winding manner through the slots configured in the air tube and across the barrel.

As best shown in FIG. 19, and upon activation of the fan component 100 by the TEG 94, in order to draw airflow into the handguard via the finned cooling blocks 104, the slot configuration in the air tube is configured to compress and drive airflow through the air tube in a vortex fashion (see air patterns 130, 132, et seq.). The winding and torsionally directed air flow is directed around and along the barrel 90 in a manner which maximized wicking away of heat from the barrel, such being further vented through the apertures 76, 78, 80, et seq. of the handguard (see additional outflow patterns 134, 136, et seq.).

As previously indicated, the air tube 118 abuts the barrel nut 88 and provides an aspect of heat dissipation additional and separate from that effectuated by the heat transfer from the barrel nut to the hand guard hot plate portion 92. It is also envisioned that variants of the invention can modify the heat dissipating aspects of either the direct barrel nut to cooling block conductivity component or TEG-to-fan-to air tube convection component, the present inventions featuring both aspects in a preferred embodiment however which can also be provided separately.

Having described my invention, other and additional preferred embodiments will become apparent to those skilled in the art to which it pertains, and without deviating from the scope of the appended claims. This can include reconfiguring the handguard to integrate many of the aspects of the interiorly positioned air tube into a single article, as well as revising the shape, location and/or arrangement of any one or more of the of the cooling fins, thermoelectric generator and vortex airflow inducing fan. It is also envisioned that the definition of the hot side (see again portion 92) of the handguard can be modified from that shown in order to provide other mechanisms for effectuating direct heat dissipating conductivity to the handguard exterior.

I claim:

1. A hand guard incorporated into a firearm having a heat generating barrel, said assembly comprising:

an elongated and tubular shaped body including a free floating tube overlaying the barrel in heat conducting fashion, a barrel nut secured to an open end of said tube and including a plurality of ventilation holes;

a Seebeck module incorporated into said body and, in response to heat emanating from the barrel, operating at least one piezoelectric blower; and a rotating blade supported within an open interior of said body which is rotated by said blower to draw the heat from said body for discharge through said ventilation holes.

2. The invention as described in claim 1, said piezoelectric blower further comprising an inner diaphragm, piezoelectric element and pump in order to create an airflow through a nozzle for in turn driving said.

3. The invention as described in claim 1, further comprising a circumferential array of cooling fins arranged upon a cooling block component located at an interface between said body and barrel nut.

4. The invention as described 3, further comprising air intake vents formed in at least said barrel nut in overlapping fashion over said fins.

5. A heat dissipation assembly for use with a barrel forming a part of a firearm upper receiver, said assembly comprising:

an annular shaped barrel nut adapted to secure the barrel to the upper receiver, an elongated handguard affixed to said barrel nut at a heat conducting location, said handguard adapted to surround a proximal extending portion of the barrel, said handguard having a plurality of apertures defined therethrough;

at least one cooling element located on an exterior of said handguard;

a thermoelectric generator incorporated into said handguard for transferring heat from said barrel nut to said cooling element; and a fan component integrated into said handguard and operated by said generator for drawing air through said apertures in order to provide additional cooling to the barrel.

6. The heat dissipation assembly as described in claim 5, said handguard further comprising an upper mounting rail.

7. The heat dissipation assembly as described in claim 5, said barrel nut further comprising a circumferentially projecting forward end attached to said handguard.

8. The heat dissipation assembly as described in claim 5, said thermoelectric generator further comprising a pair of generators at opposite rear proximate sides of said handguard in proximity to said barrel nut, each of said generators each including a pair of wires in communication with and for driving said fan component.

9. The heat dissipation assembly as described in claim 5, said at least one cooling element further comprising a finned cooling block defining an interior within which is seated said fan component.

10. The heat dissipation assembly as described in claim 9, said finned cooling block further comprising a first cooling block position on an upper first side of said handguard and a second cooling block position on a lower second side of said handguard.

11. The heat dissipation assembly as described in claim 5, said at least one cooling element further comprising a pair of cooling plates each including a multi-sided and inter-angled configuration which is mounted to an exterior surface location of said handguard via screws.

12. The heat dissipation assembly as described in claim 5, further comprising an air tube secured within the interior of said handguard body in abutting contact against a forward end of said barrel nut for communicating airflow drawn from said fan component across the barrel.

13. The heat dissipation assembly as described in claim 12, said air tube further comprising an annular projecting inner end integrating an arcuate side extending passageway which aligns underneath said fan component, additional torsionally directed airflow passageways being configured within said air tube in communication with said side extending passageway.

14. A heat dissipation assembly for use with a barrel forming a part of a firearm upper receiver, said assembly comprising:

a barrel nut adapted to secure the barrel to the upper receiver, a handguard affixed to said barrel nut at a heat conducting location, said handguard adapted to surround a proximal extending portion of the barrel, said handguard having a plurality of apertures defined therethrough;

a first cooling block position on a first side of said handguard and a second cooling block position on a second side of said handguard, each of said cooling blocks exhibiting a plurality of elongated apertures separating fins;

a pair of cooling plates each including a multi-sided and inter-angled configuration which are mounted to exterior surface locations of said handguard;

a thermoelectric generator incorporated into said handguard for transferring heat from said barrel nut to said plates; and a fan component seated within a pocket defined in at least one of said cooling blocks and operated by said generator for drawing air through said elongated apertures and into said handguard interior in order to provide additional cooling to the barrel.

15. The heat dissipation assembly as described in claim 14, said handguard further comprising an upper mounting rail.

16. The heat dissipation assembly as described in claim 14, said barrel nut further comprising a circumferentially projecting forward end attached to said handguard.

17. The heat dissipation assembly as described in claim 14, said thermoelectric generator further comprising a pair of generators at opposite rear proximate sides of said handguard in proximity to said barrel nut, each of said generators each including a pair of wires in communication with and for driving said fan component.

18. The heat dissipation assembly as described in claim 14, further comprising an air tube secured within the interior of said handguard body in abutting contact against a forward end of said barrel nut for communicating airflow drawn from said fan component across the barrel.

19. The heat dissipation assembly as described in claim 18, said air tube further comprising an annular projecting inner end integrating an arcuate side extending passageway which aligns underneath said fan component, additional torsionally directed airflow passageways being configured within said air tube in communication with said side extending passageway.

* * * * *